US006675993B2

(12) United States Patent
Morck

(10) Patent No.: US 6,675,993 B2
(45) Date of Patent: Jan. 13, 2004

(54) PRESSURIZED CAN WITH INNER SHELL

(76) Inventor: Rouven Morck, Hanruckstrasse 77, D-55595 Hargesheim (DE)

( * ) Notice: Subject to any disclaimer, the term of this patent is extended or adjusted under 35 U.S.C. 154(b) by 0 days.

(21) Appl. No.: 09/953,487

(22) Filed: Sep. 15, 2001

(65) Prior Publication Data

US 2002/0088724 A1 Jul. 11, 2002

(30) Foreign Application Priority Data

Sep. 15, 2000 (EP) ..... 00120092

(51) Int. Cl.[7] ..... B65D 83/14
(52) U.S. Cl. ..... 222/399; 222/129; 222/145.1
(58) Field of Search ..... 222/80, 129, 130, 222/145.1, 190, 209, 386.5, 399, 402.1

(56) References Cited

U.S. PATENT DOCUMENTS 4,651,899 A * 3/1987 Pauls et al. ..... 222/130
4,769,395 A * 9/1988 Pauls ..... 521/99
5,927,563 A * 7/1999 Kellner ..... 222/402.22

* cited by examiner

*Primary Examiner*—Michael Mar
*Assistant Examiner*—Melvin A Cartagena
(74) *Attorney, Agent, or Firm*—Fulbright & Jaworski LLP

(57) ABSTRACT

Pressurized can with a can body (2), a valve (4) located in a dome (3), a bottom (5) with inset crimp disc (6) and an inner shell (7) positioned on the crimp disc (6) with a closure (8) that can be pried off, a ram (9) with a section inside (9*a*) and a section outside (9*b*) of the inner shell (7), and a sealing element (10) on the ram (9), wherein the inner shell (7) is injection molded onto the crimp disc (6), the inner shell (7) has a shaft (13) for the ram (9) that projects through the center of the crimp disc (6) that ends underneath the crimp disc (6), the ram (9) has a sealing element (10) that acts against the shaft (13) and is movable within the shaft (13) and the ram (9) has an inner (14) and an outer (15) limiting element that limit the free path length of the ram (9).

26 Claims, 4 Drawing Sheets

PRIOR ART

PRESSURIZED CAN WITH INNER SHELL

CROSS-REFERENCE TO RELATED APPLICATIONS

This application claims the benefit of European application No. 0 0120 092.2 filed Sep. 15, 2000.

STATEMENT REGARDING FEDERALLY SPONSORED RESEARCH OR DEVELOPMENT

Not Applicable

INCORPORATION BY REFERENCE OF MATERIAL SUBMITTED ON A COMPACT DISC

Not Applicable (1) Field of the Invention

The field of the invention is pressurized cans suitable for the transport and discharge of reactive products for the production of foams and for surface techniques.

(2) Description of Related Art Including Information Disclosed Under 37 CFR 1.97 and 1.98

The invention concerns a pressurized can with a can body, a valve positioned in a dome, a bottom with inset crimp disc and an inner shell with a pry-off closure positioned on the crimp disc, a ram with a section inside of and a section outside of the inner shell and a sealing element, which is in particular suitable for the transport and discharge of reactive products for the production of foams and for surface techniques.

The invention primarily relates to the design of pressurized cans that contain, aside from the main component fluid substances that are required for the creation and discharge of polyurethane or similar foams, a second component in the inner shell which reacts with the main component to form the final product, the actual insulating foam. However, the invention can be used equally well for 2-component formulations for other purposes, for instance in surface techniques, for example, for multi-component finishes.

As a rule, the substances contained in the pressurized container are liquid and consist of a prepolymer, a foaming agent, if necessary, and the fluid propellant gas that is used to discharge the components. The additional component is present in a relatively small amount and mostly consists of a compound that reacts quickly with the main component, for example, for polyurethane prepolymers with reactive isocyanate groups, a cross-linking agent in the form of, for instance, a hydroxyl compound and catalysts, if necessary. The component in the inner shell is used to influence, as a rule to accelerate, the hardening and quality of the foam. As a rule, the second component is introduced into the pressurized can shortly before discharge of the foam by prying off the inner container cover, and is mixed there by shaking.

A pressurized can with a single-piece bottom formed from a metal forming piece is known from DE-U-82 27 229.8. The neck of the additional container, which has an outside thread, is introduced into a recess in this bottom, and secured from the outside by screwing on a nut and compressing an O-ring seal between the shoulder of the additional container and the inner rim of the bottom recess. The sealed rod, which, in its turn, is executed as a piston-shaped seal in the interior of the additional container, is designed as an arbor that turns in and rests against the inside of the neck of the additional container. If the arbor is driven from the outside, this leads to positive contact between its inner end and the cover of the additional container, causing it to be pried off into the can against the internal pressure.

The invention itself is based on WO-A-85 00 157, which describes a pressurized can for discharging single or multi-component substances that contains an additional container in its interior for holding an additional component. The inner container has an inner cover that can be pried off by a rod that passes through the bottom of the pressurized can into the interior of the inner container. The ram is movably mounted inside the additional container and passes through a seal located in the crimp disc of the can bottom. A pressurized can according to EP-A-0 148 211 is shown in FIG. 1.

Both pressurized cans according to current techniques require relatively expensive design and assembly. In addition, the container according to DE-U-82 27 229 suffers from a relatively complicated mechanism. Although the cover is pried off against the relatively large internal pressure of the container by the rotary movement of the rod, this requires a relatively large amount of effort and, in addition, requires a complex and expensive seal system.

Although the pressurized can according to WO-A-85 00 157 has proven itself overall and represents a significant improvement compared to the mentioned registered design, introducing the ram through the rubber seal mounted in the crimp disc is problematic and requires a non-optimal ram geometry.

BRIEF SUMMARY OF THE INVENTION

The invention is therefore based on the problem of further developing the pressurized can according to WO-A-85 00 157 so that the parts of the inner shell are more easily assembled to form a non-separating and perfectly sealed unit and so that at the same time a user needs to exert relatively little force to cause the closure part of the inner shell to be pried off.

This problem is solved by the pressurized can of the type initially mentioned, in that the inner shell is injection molded onto the crimp disc, the inner shell has a shaft for the ram that projects through the center of the crimp disc and ends underneath the crimp disc, the ram has a sealing element that acts against and is movable within the shaft and the ram has an inner and an outer limiting element that limit the path length of the ram.

It is essential for the pressurized can according to the invention that the inner shell of the pressurized can is injection molded onto the crimp disc. This measure creates an integral connection between the inner shell and the crimp disc that results in the inner shell being fixed immovably above the bottom of the pressurized can, in an expedient manner, the crimp disc has holes in the part of its bottom into which injection molding is performed, through which the injection molding compound can penetrate and reinforce the connection between crimp disc and inner shell.

The inner shell has a shaft that passes through the open center of the crimp disc and ends above the crimp disc. At the same time, the ram has a sealing element that acts against the inner shaft wall and is movable within the shaft and which seals the interior of the inner shell at the bottom. The seal to the can interior is provided by a closure element located at the upper end of the shaft, a cover for instance. The sealing element, which is movable inside the shaft, also serves to guide the ram in the interior of the inner shell.

In order to set limits on the free path length of the ram in the axial direction, the ram has an inner and an outer limiting element, the inner limiting element located above or on the dome side of the sealing element and the other below or on the bottom side of the sealing element. On the one hand, the limiting elements prevent the ram from being pulled too far out of the inner shell and, on the other, prevent it from being pushed in too far when the closure is pried off. In both cases, the sealing element would lose its contact with the shaft and, is consequently, its ability to provide a seal.

In the part of the crimp disc around which injection molding has been performed, there is preferably a section extending axially that is undercut when viewed from the outside and engages inside the outer wall of the inner shell. In a preferred embodiment, an O-ring is present in this undercut, which, on the one hand, exerts a certain inward pressure on the crimp disc and, on the other, serves as an additional seal between inner shell and crimp disc. The O-ring works against the pressure of the propellant present in the pressurized can, which acts in particular in the bottom region and can produce deformations there, and prevents infiltration of the shell.

The sealing element on the ram is likewise expediently an O-ring positioned in a groove encircling the ram. The seal, together with the ram, can be moved along the inner wall of the shaft and allows the ram to move inwards a prescribed path length in order to pry off the shell closure, with path length determined by the outer limiting element.

The shaft expediently has a smooth even rim on its inner or dome-side end that serves as a seat for the inner or dome-side limiting element on the ram. The inner limiting element is preferably a disc or a disc-shaped projection. If this disc is at the rim of the shaft, the ram is at the lower or outer end or resting position, i.e. in the position in which the can is secured and can be stored and transported.

The outer limiting element is located on the ram below the sealing element, i.e. on the side of the ram towards the bottom. It acts in combination with a corresponding abutment on the inner wall of the shaft that defines an upper end position for the limiting element and therefore determines how tar the ram can be pushed into the shaft or inner shell. The room for movement of the ram between the end-stop points of the inner and outer limiting elements corresponds to the path that the ram must travel in order to move from its resting position and ensure that the inner shell closure is pried off. The abutment consequently defines the upper or inner end position of the ram following activation of the inner shell.

The outer limiting element is preferably a projection in the form of a truncated cone circling the ram that widens in the direction of the inner shell or the dome of the can. The abutment acting in combination with the limiting element consists preferably of two opposing projections from the inner wall of the shaft that are approximately circular segment-shaped.

In order to conserve volume, the ram itself has a cross-shaped cross-section. In order to ensure that it acts optimally in combination with the above-described abutment for the outer limiting element, the ram cross-section is unequal in the vicinity of the outer abutment, i.e. with short arms opposite to one another and long arms opposite to one another. The shorter arms make a more extreme elastic deformation of the truncated cone possible in their vicinity, so that during assembly the ram can be pushed through the inner shell into the shaft and the outer limiting element can be moved past its abutment. The truncated cone consequently acts as a stop only in the direction of the can interior.

In an preferred embodiment, the ram has a head on its dome-side end that has a diameter that essentially corresponds to the inside diameter of the inner shell. "Essentially" means here that the diameter is slightly smaller than the inside diameter of the inner shell, so that, on the one hand, a guideway is guaranteed and, on the other, sufficient play is available so that the ram can be guided effortlessly, if necessary past flat projections used to fix the closure in place, and can therefore fulfil its purpose. So that the head does not take up too much volume, it is expediently multi-vaned, having in particular a cross-shaped cross-section. In this regard, it has proven to be advantageous if the head is beveled in its vane region, i.e. the tip of one vane defines the point of the ram that is farthest from the bottom and the remaining parts of the head fall back smoothly. In this way, point contact is made with the inner shell closure in the vicinity of the shell wall so that the force exerted by the ram can be transferred optimally.

The inner shell expediently has a cover put onto it, which is sealed to the inner shell by an O-ring. In order to achieve a positive connection, it is furthermore expedient to provide a point-form or circumferential projection on the inner wall of the inner shell that engages in a corresponding groove in the cover.

A special and independent aspect of this invention is the design of the inner shell closure for pressurized cans as an extension of the inner shell, which, in turn, again has the above-described cover. This extension of the inner shell can, as described above for the cover, be put onto the inner shell and is sealed against the pressurized can contents by an O-ring. This variant allows inner shells for a variety of volumes to be prepared that can be opened with a uniform pry-off mechanism. This allows the volume of the inner shell to be easily adjusted to the can size and the intended use.

The Inner shell preferably has, in particular when a head with multiple vanes is present, a guide extending longitudinally that is useful when inserting the ram into the shaft. The guide allows the ram to be positioned in such a way that the collar in the vicinity of the short arms of the ram, as described above, passes by the point-form abutments of the shaft with which it acts in combination.

The invention concerns, in accordance with another independent feature, a cap that acts in combination with the outer ram end via a central receptor. For this purpose, the ram expediently has a cylindrical knob that is positively received by a corresponding cylindrical receptor in the cap. This measure leads to the ram knob having a defined position within the cap and allows the mixing process to be easily activated.

The cap itself has a cylinder-shaped wall that can engage into the space formed by the axially extending side boundaries of the crimp disc.

In accordance with a special embodiment, the cap has a ring on the wall that is mounted so that it can move axially and that acts in combination with an external wall projection via an inner circumferential projection and defines a lower or outer end position of the cap. The ring acts as an adapter shell and a connection between the can bottom or crimp disc and the cap.

In accordance with another preferred embodiment, the ring itself has an outer circumferential bead that engages inside, behind an axial side wall of the crimp disc, i.e. is mounted in the crimp disc itself. In this way, the cap is held on the can bottom and is, at the same time, movably mounted in such a way that the ram knob that it holds can be pushed into the can interior to activate the inner shell by pushing the cap. Naturally, the free path of the ram defined by the length of the adapter shell must be matched to the path defined by the outer limiting element, i.e. must essentially agree with it. Since the pressurized can contents are under pressure, activation of the inner shell must not lead to failure of the seal between inner shell and can bottom allowing the can contents a free path through this opening.

In order to define an upper or inner end position of the cap, i.e. the nearest possible position of the cap relative to the can bottom, it is advantageous for the cover of the cap to protrude on the sides and form an end stop for the ring or adapter shell.

BRIEF DESCRIPTION OF THE SEVERAL VIEWS OF THE DRAWINGS:

The invention is explained in more detail by the accompanying figures, which show:

Figure 1:
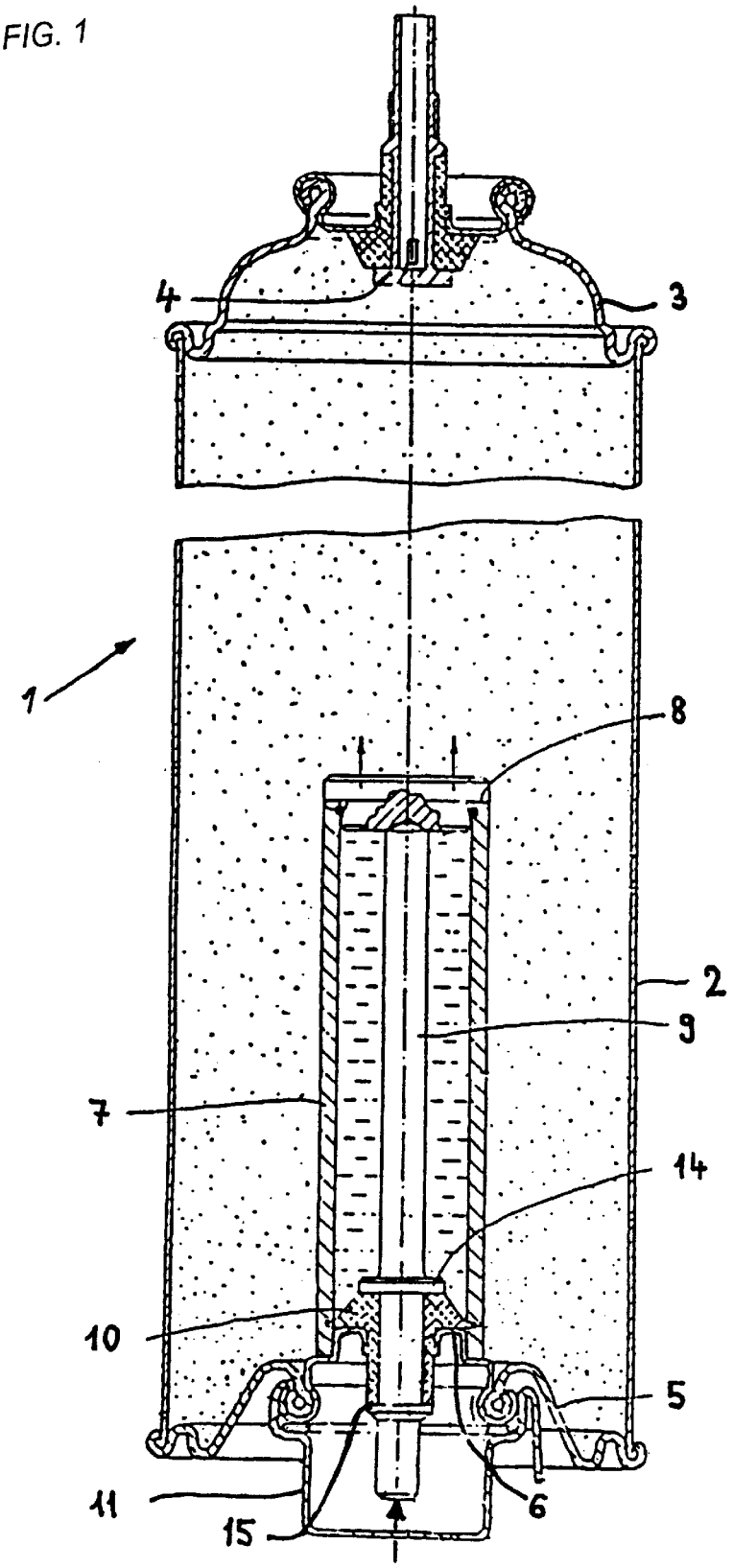
Figure 2:
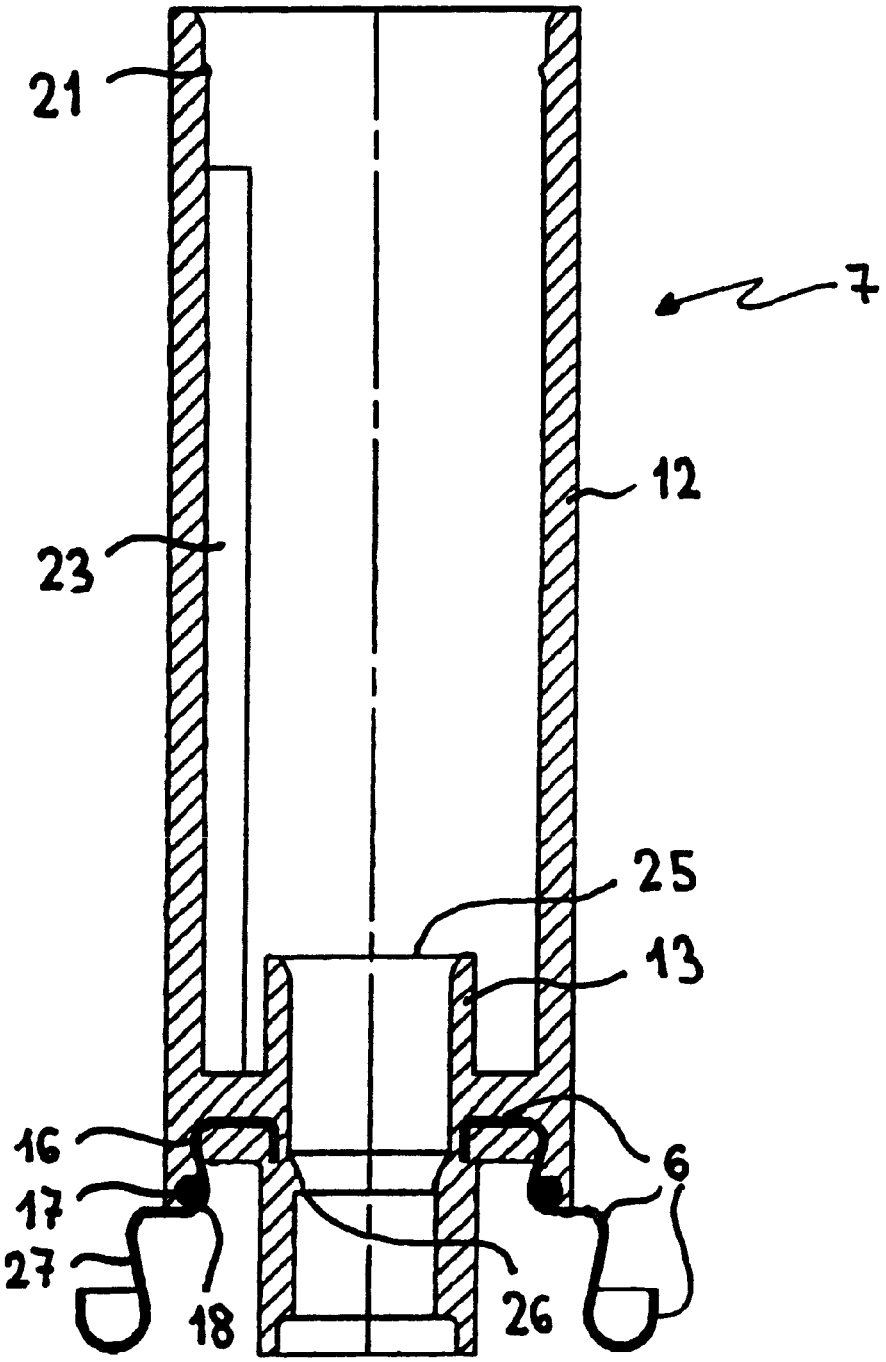
Figure 3:
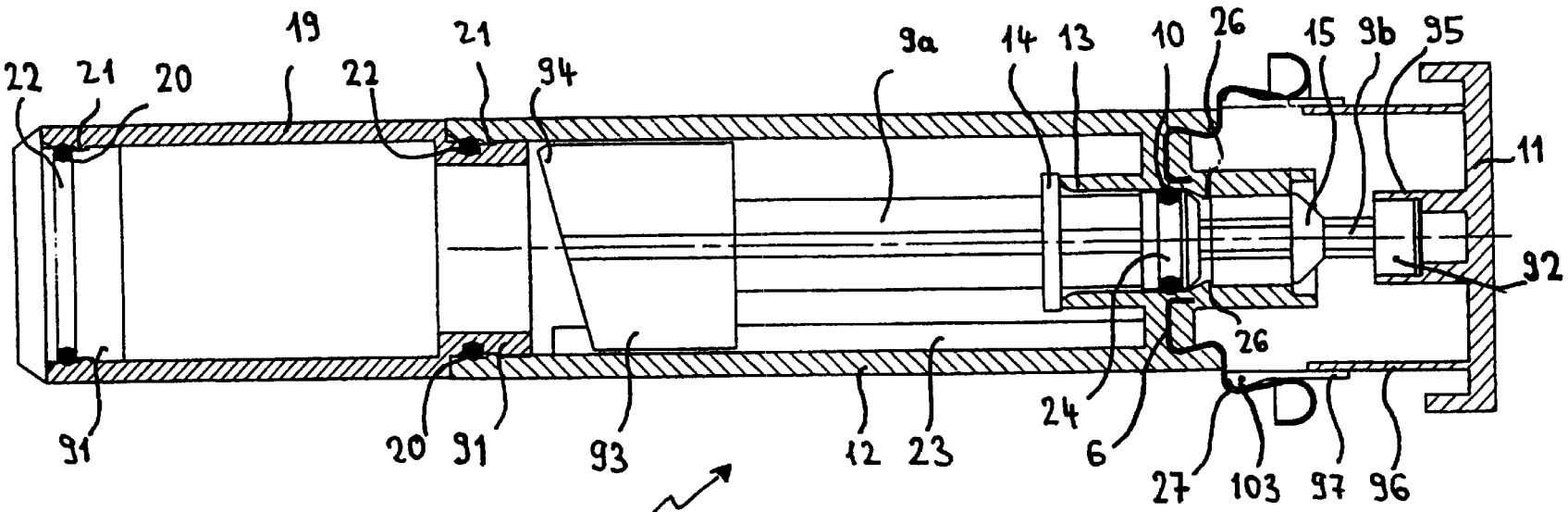
Figure 4:
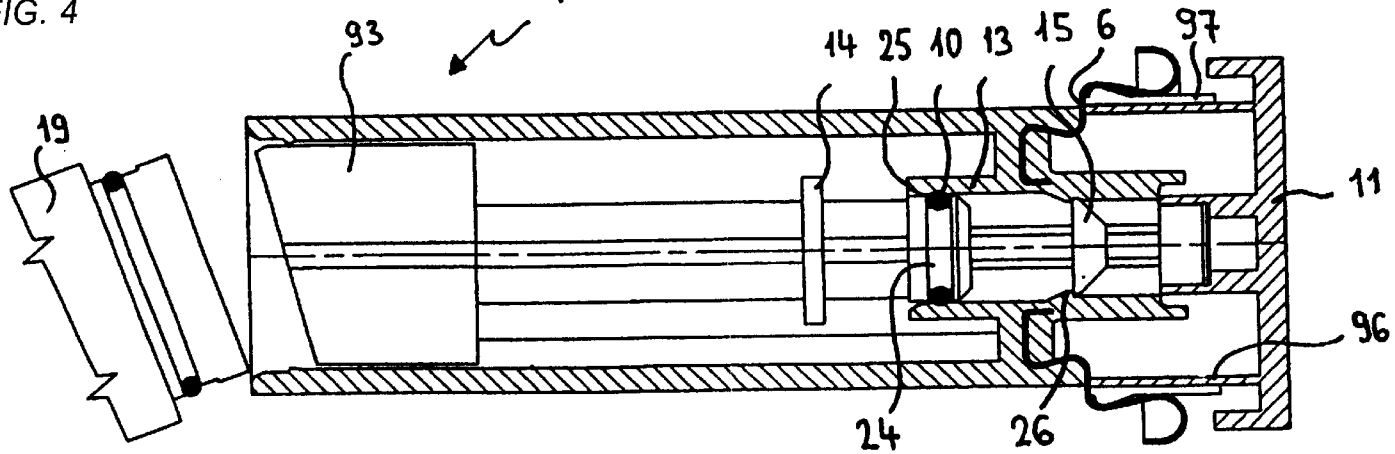
Figure 5B:
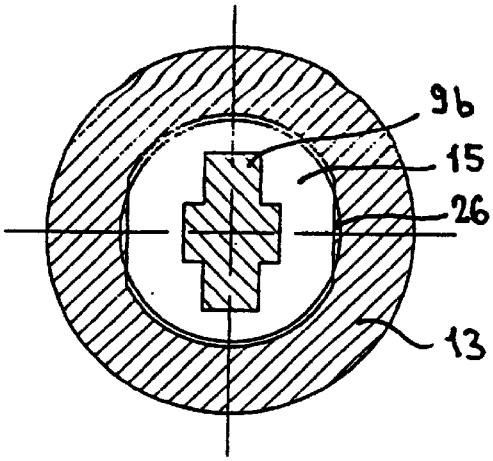
Figure 5A:
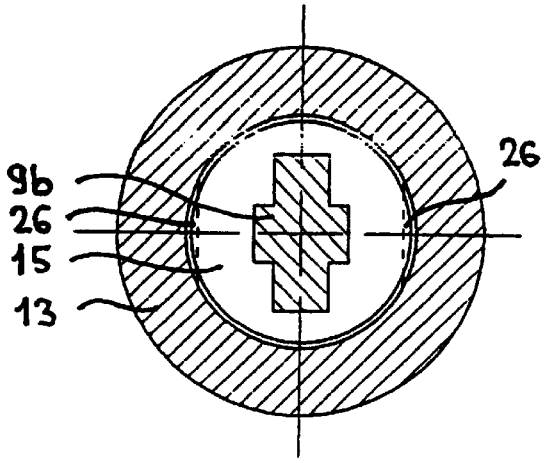
Figure 6:
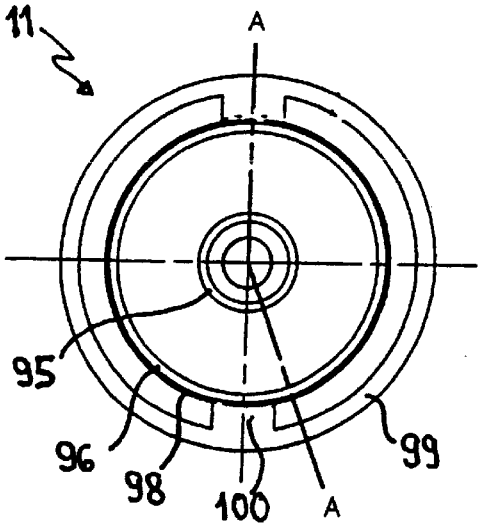
Figure 7:
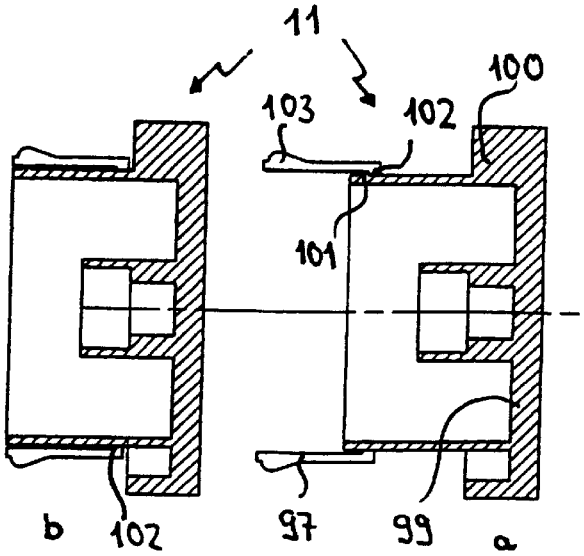

| | |
|---|---|
| FIG. 1 | a pressurized can with inner shell according to current techniques (WO-A-85 00 157); |
| FIG. 2 | an inner shell for a pressurized can according to the invention without cap and ram; |
| FIG. 3 | an inner shell with cap placed on it and a ram that has been inserted and is in the resting position; |
| FIG. 4 | the inner shell of FIG. 3 in its activated state; |
| FIG. 5 | the vicinity of the outer limiting element as seen from the bottom side (5a) and from the dome side (5b); |
| FIG. 6 | the cap without adapter ring; and |
| FIG. 7 | the cap with adapter ring along line A—A in FIG. 6. |

FIGS. 1 to 5 and 7 show sectional views.

DETAILED DESCRIPTION OF THE INVENTION

The pressurized can 1 shown in FIG. 1 consists of a can body 2 that is closed at the upper end with a dome 3. The dome 3 has a crimped edge that connects the dome 3 with the can body 2 and simultaneously produces a sealed connection between the parts. The dome 3 is manufactured from a round plate, a forming piece cut from sheet metal that is formed so that it takes on the dished shape that is shown in the drawing. The inner edge of the dome 3 is also crimped and connects a valve disc with a valve 4.

The bottom 5 is likewise connected to the can body 2 by a crimped edge and has a crimp disc 6 in its center, above which is located the inner shell 7. The inner shell 7 has a cover 8 that can be pried off. In the interior of the inner shell 7 is a ram 9, whose end projects out of the pressurized can through a sealing element 10. On both sides of the sealing element 10, the ram has limiting elements, an upper or inner limiting element 14 and a lower or outer limiting element 15, both of which act against the sealing element 10 and limit the free path length of the ram 9 inside of the inner container 7. To pry off the cover 8 from the inner container 7, the ram 9 is pushed in and set in upward motion by striking the can bottom on a solid surface. The rubber-elastic sealing element 10 absorbs this upward motion and returns the ram 9 to its initial position after the cover has been pried off. A cap 11 protects the ram end.

FIG. 2 shows an inner shell without ram and cap that is used according to the invention. The inner shell 7 has a cylindrical wall 12 that is injection molded onto the crimp disc 6 at its lower end. In this regard, the crimp disc 6 consists of a formed sheet metal part that is made up of horizontal and vertical partial sections and ends in a bottom section which is crimped with the bottom 5 of the pressurized can.

In the vicinity of the parts into which injection molding is performed, the crimp disc 6 has holes (not shown) through which the plastic injection molding compound penetrates, thereby solidly embedding the parts of the crimp disc around which injection molding has been performed. In the inner axially extending section 16 of the crimp disc, which is dished or undercut inwards, in curve 18 there is a rubber seal 17 in the form of an encircling O-ring lying on the inside against the wall of the crimp disc and which is enclosed from the outside by the plastic compound of the inner shell 7. The crimp disc 6 has another outer axial section 27 that acts in combination with the cap 11.

In the vicinity of the crimp disc, the inner shell 11 has a shaft 13 that extends through the crimp disc 6 and out of the can. The shaft ends a distance above the crimp disc 6 and has a horizontally extending upper rim 25. The inner wall of the shaft is cylindrical and acts in combination with the sealing element 10 of the ram that has been passed through it. Projections 26 in the approximate vicinity of the parts of the crimp disc into which injection molding has been performed simultaneously define the lower end-stop point of the sealing element 10 in the upper part of the shaft and the abutment for the outer limiting element 15 of the ram 9.

Furthermore, inside the inner shell there is a guide 23 that acts in combination with the head 93 of the ram 9 and makes assembly of the ram 9 by insertion through the open side of the inner shell 7 into the shaft easier.

A circumferential projection 21 in the immediate vicinity of the open side of the inner shell acts in combination with correspondingly designed grooves 22 of a cover 8 or extension shell 19.

FIG. 3 shows an inner shell with inserted ram and a cap put on it that is used according to the invention, in which the ram 9 is in its resting position, i.e. the inner shell has not been activated. The ram consists of two partial sections 9*a* and 9*b*, section 9*a* lying inside the inner shell and section 9*b* projecting through the crimp disc 6 and consequently out of the pressurized can 1.

In the vicinity of the crimp disc, in a circumferential groove 24 of the ram 9, is the sealing element 10 in the form of an O-ring, which acts against the inner wall of the shaft 13 and can be moved with the ram 9 within the limits defined by the limiting elements 14 and 15.

The inner limiting element 14 is located on section 9*a* of the ram and has the shape of a disc that lies on the inner rim 25 of the shaft 13 in the resting position of the ram 9. The outer limiting element 15 has the shape of a truncated cone with its angled surfaces pointing away from the can bottom, The limiting element 15 acts in combination with abutments 26 on the inside of the shaft, which define the inner position of the collar 15 and consequently of the ram 9 following activation of the inner shell 7.

The ram 9 itself has an essentially cross-shaped cross-section, with the arms of the cross having approximately the same lengths in region 9*a* of the ram and shorter arms opposite to each other and longer arms opposite to each other in the outer section 9*b*. As already mentioned, this makes assembly of the ram 9 by insertion through the inner shell 7 and shaft 13 easier.

Section 9*b* of the ram ends in a knob 92, while the head 93 is located on the inner end of the ram 9. The head 93 itself is multi-vaned and beveled at its end in such a way that one vane ends in a tip 94. This tip 94 is near to the wall 12 of the inner shell 7 and acts in combination with the section 91 of the extension shell 19 or a cover 8 that projects into the inner shell 7 in such a way that when the ram is pushed, point-force pressure is exerted on shell 19 or cover 8 near the rim, separating it from the inner shell 7, The tip 94 is slightly beveled in the direction of the wall 12 of the shell 7 in order to prevent blocking on the projection 21, preferably a circumferential lip on the inner wall 12 of the inner shell 7.

The inner shell 19 has a circumferential groove in its section 91 that acts in combination with the projection 21 of the inner shell 7. An O-ring located in another groove 22 ensures that the inner shell 7 is sealed against the rest of the can contents. The cover 8, which can replace the shell 19 altogether, has a corresponding geometry.

Underneath the crimp disc 6 is the cap 11, which receives the knob 92 of the ram 9 in a receptor 95 located its center. The cylindrical side wall 96 has a cylindrical adapter ring 97, which has an outward-pointing bead 103 on its side pointing out from the cap that engages in the crimping undercut 27 of the crimp disc 6 and latches there. The cap 11 along with its wall 96 is movable within the ring 97 and is suitable, when it is pushed in the direction of the can, for moving the ram in the direction of the cover 8 or the extension shell 19 and prying it off, without the position of the adapter ring 97 changing.

FIG. 4 shows the inner shell of FIG. 3 in the activated state with shell 19 or cover 8 pried off.

In the activated state, the head 93 is on the dome-side end of the inner shell 7 and has forced the shell 19 or cover 8 out of the previous position. The disc-shaped limiting element 14 has moved with the ram 9 further into the shell and the truncated cone-shaped limiting element 15 has moved to the abutment 26, on which it rests. The cap 11 and its wall 96 has moved behind the adapter ring 97 and rests against the bottom of the crimp disc 6. The sealing element 10 in the groove 24 is, as before, in the region of the shaft 13 a safe distance from the shaft rim 25, ensuring, as before, the presence of an effective seal. Discharge of the can contents through the shaft 13 is consequently prevented.

FIG. 5 shows cross-sections through the shaft 13 of FIGS. 4 and 5, with a view of the outer limiting element 15 from above (FIG. 5*a*) and below (FIG. 5*b*). The cross-shaped cross-section of the ram 9 in the outer region 9*b* with shortened crossarm can be seen clearly. Number 13 indicates the shaft of the inner shell 7 and number 15 indicates the outer limiting element, which has a slightly smaller diameter than the shaft 13. The abutments 26, which are covered to a large degree by the sealing element 15, are indicated with dashed lines (FIG. 5*a*) and consist of opposing circular segment-shaped projections lying opposite to one another on the inner wall of the shaft 13.

Since the inner shell consists of a plastic material that can be injection molded and has a certain residual elasticity overall, it is possible, when assembling the ram 9, to push it, along with the limiting element 15, from the inside of the shell 7 through the shaft. When doing so, it is necessary to guide the edge of the limiting element 15 past the abutments 26, which is only possible with sufficient elasticity of the material, The shortened arms of the ram cross 9 in this region reduce the rigidity of the limiting element in the same direction and consequently make movement past the abutments 26 easier. The truncated cone shape of the limiting element 15 acts in the same direction.

FIG. 5*b* shows the same situation from the inside of the inner shell looking out. The abutments 131, which limit the path of the limiting element 15 in the direction of the can interior or the dome can be seen clearly. The truncated cone or collar shape of the limiting element 15 causes the limiting element to spread out, preventing passage over the abutment 26.

FIG. 6 shows the cap 11 without the adapter ring 97 from the underside, with the receptor 95, the wall 96, a circumferential projection 98 on the wall and a cap cover 99 that projects over the wall on all sides. The cover 99 is turned down vertically parallel to wall 96 and has two opposing inwards-facing projections 100 that serve as abutments for the adapter ring 97, which is not shown.

FIG. 7 shows the cap 11 with adapter ring 97 along section A—A of FIG. 6, with extended (7*a*) and retracted (7*b*) adapter ring 97. The purpose of the (circumferential) projection 101, which acts in combination with a corresponding projection 102 on the adapter shell 97 and defines a lower end position for the combination of cover 11 and adapter shell 97, is made clear. The projection 100 acts in the same direction and defines an upper end position of the adapter shell 97.

What is claimed is:

1. Pressurized can with a can body, a valve located in a dome, a bottom with inset crimp disc and an inner shell positioned on the crimp disc with a closure that can be pried off, a ram with a section inside and a section outside of the inner shell, and a sealing element on the ram, wherein the inner shell is injection molded onto the crimp disc, the inner shell has a shaft for the ram that projects through the center of the crimp disc that ends underneath the crimp disc, the ram has a sealing element that acts against the shaft and is movable within the shaft and the ram has an inner and an outer limiting element that limit the free path length of the ram.

2. Pressurized can according to claim 1, wherein the crimp disc has holes in the part of the bottom into which injection molding has been performed.

3. Pressurized can according to claim 1, wherein the crimp disc has an axially extending segment with an indentation in the part around which injection molding has been performed.

4. Pressurized can according to claim 3, wherein the crimp disc has an O-ring in the indentation of the axially extending segment.

5. Pressurized can according to claim 1, wherein the ram has an O-ring in a circumferential groove as a sealing element.

6. Pressurized can according to claim 5, wherein the shaft has a smooth rim at its end situated in the inner shell, which serves as a seat for the inner limiting element located on the ram and defines the end position of the ram in the resting position.

7. Pressurized can according to claim 6, wherein the inner limiting element is a circular segment-shaped projection.

8. Pressurized can according to claim 1, wherein the shaft has an abutment for the outer limiting element that defines the end position of the ram following activation of the inner shell.

9. Pressurized can according to claim 8, wherein the outer limiting element is a truncated cone-shaped projection that widens in the direction of the inner limiting element.

10. Pressurized can according to claim 8, wherein the abutment consists of two opposing projections on the inner wall of the inner shell.

11. Pressurized can according to claim 8, wherein the ram has a cross-shaped cross-section.

12. Pressurized can according to claim 11, wherein the ram has a cross-shaped cross-section in its part that is located outside of the inner hull, so with long arms opposite to one another and short arms opposite to one another, where the short arms point in the direction in which the limiting element acts in combination with the abutment.

13. Pressurized can according to claim 1, wherein the ram has a head on its part inside the inner shell with a diameter essentially corresponding to the inside diameter of the inner shell.

14. Pressurized can according to claim 13, wherein the head is multi-vaned and, in particular, has a cross-shaped cross-section.

15. Pressurized can according to claim 14, wherein the head has an end beveled in such a way that one vane end defines the point of the ram furthest from the bottom.

16. Pressurized can according to claim 1, wherein the inner shell has a cover put on it.

17. Pressurized can according to claim 16, wherein a seal is produced between cover or shell and the inner shell by an O-ring.

18. Pressurized can according to claim 17, characterized by a projection on the inner shell that acts in combination with a groove on the cover or shell.

19. Pressurized can according to claim 1, wherein the inner shell has a shell put on it.

20. Pressurized can according to claim 1, wherein the inner shell has a longitudinally extending guide on its inner wall.

21. Pressurized can according to claim 11, characterized by a cap that acts in combination with the bottom ram end via a central receptor.

22. Pressurized can according to claim 21, wherein the bottom end of the ram is formed by a cylinder-shaped knob and the cap has a cylindrical-shaped receptor that positively receives the knob.

23. Pressurized can according to claim 21, wherein the cap has a cylinder-shaped wall that engages in a space formed by the side boundaries of the crimp disc.

24. Pressurized can according to claim 23, wherein the cap has an axially-movable adapter ring mounted on the wall that acts, via an inner projection, in combination with an outer projection of the wall and defines an extended end position of the cap relative to the adapter ring.

25. Pressurized can according to claim 24, wherein the adapter ring has an outer circumferential bead that engages behind an undercut axial side wall of the crimp disc.

26. Pressurized can according to claim 24, wherein the cap has a cover that projects over the cap on the sides and defines a retracted end position of the cap relative to the adapter ring.

* * * * *